United States Patent [19]

Bonnor et al.

[11] 4,391,772

[45] Jul. 5, 1983

[54] PROCESS FOR THE PRODUCTION OF SHAPED PARTS FROM POWDERS COMPRISING SPHEROIDAL METAL PARTICLES

[75] Inventors: Yannick Bonnor; Gerard Raisson, both of Nevers; Yves Honnorat, Orsay, all of France

[73] Assignee: Creusot-Loire, Paris, France

[21] Appl. No.: 202,825

[22] Filed: Oct. 31, 1980

[30] Foreign Application Priority Data

Nov. 14, 1979 [FR] France ..... 79 28066

[51] Int. Cl.[3] ..... B22F 1/00; B22F 3/00; C22C 1/04

[52] U.S. Cl. ..... 419/23; 419/36; 419/37; 419/54; 75/0.5 C

[58] Field of Search ..... 75/200, 211, 221, 224, 75/0.5 C; 419/23, 36, 37, 54

[56] References Cited

U.S. PATENT DOCUMENTS

| | | | |
|---|---|---|---|
| 2,598,796 | 6/1952 | Halthen et al. | 75/221 |
| 3,725,142 | 4/1973 | Huseby | 75/211 |
| 3,988,524 | 10/1976 | Dreeger et al. | 75/221 |
| 4,298,383 | 11/1981 | Joyce | 75/211 |

FOREIGN PATENT DOCUMENTS 7343159 6/1975 France .

7345788 7/1975 France .

*Primary Examiner*—Gregory A. Heller

*Attorney, Agent, or Firm*—Pollock, Vande Sande & Priddy

[57] ABSTRACT

The invention is directed to the production of non-fragile shaped members from powders comprising spheroidal metal particles.

For this purpose, the invention provides a process for the production of shaped parts from powders comprising spheroidal metal particles which are mixed with from 0.2% to 2% of lubricant, comprising the combination of the following successive steps, performed in the below-indicated order:

(a) mixing the powder formed by spheroidal metal particles with an amount of water-soluble cellulose gum between 0.2% and 2%, and with an amount of water which is also between 0.2% and 2%;

(b) a cold compacting operation;

(c) an optional oven drying operation;

(d) a two-phase sintering operation, in an atmosphere which is neutral or reducing with respect to the compacted powder, the first phase being effected at a temperature of from 300° to 500° C. and the second phase being effected at a temperature which is substantially higher and variable with the nature of the powder.

5 Claims, No Drawings

PROCESS FOR THE PRODUCTION OF SHAPED PARTS FROM POWDERS COMPRISING SPHEROIDAL METAL PARTICLES

FIELD OF THE INVENTION

The invention concerns the production of non-fragile shaped or molded parts from powders comprising spheroidal metal particles.

This invention makes it possible to use such powders in circumstances in which the known methods of mechanical compacting produced blanks which were too fragile to be handled under industrial production conditions.

BACKGROUND OF THE INVENTION

In general, in order to assure that a compressed component has mechanical strength and resistance to disintegration or crumbling, the material used is a powder with an irregular grain shape, characterized by a substantial specific surface area with respect to the grain size. The mechanical interengagement of the grains in the compacting operation assures that the component has a sufficient level of mechanical strength for all the handling operations required in respect of the compressed component. Powders with an irregular grain shape are generally produced by a water atomization process. This process comprises spraying a jet of liquid metal with one or more jets of water under pressure. The powder is projected into a water bath for concluding cooling thereof. After settling, the powder is dried and subjected to a first de-oxidation or reduction operation. The powder produced has a grain size which for the major part is less than 160 microns. The shape of the grains depends on the composition and the conditions of the atomization operation, which is generally fairly turbulent. On the other hand, as the powder is required to be subjected to a reduction step, its composition in respect of alloy elements must be limited to those whose oxides can be easily reduced. For example, for steels which are substantially non-alloyed, the typical composition AISI 4600 contains 2% of nickel and 0.8% of molybdenum. Chromium-manganese compositions which are less expensive can be produced only at the expense of a burdensome treatment for reduction using carbon at a temperature of 1200° C., followed by crushing of the sintered powder.

The process for atomization by means of a neutral gas makes it possible totally to avoid this problem in regard to composition. Such a process comprises spraying a jet of liquid metal with a plurality of jets of gas under pressure. Solidification of the droplets and cooling of the powder take place in a confined chamber; the spraying gas which fills the chamber is neutral with respect to the atomized metal. Depending on the composition used, the gas may be either argon or nitrogen. The atomization chamber and apparatus may be advantageously designed on the basis of the principles of French Pat. Nos. 73-43159 or 73-45788. The grain size of the resulting powder is between a few microns and 500 microns, with a spheroidal grain shape. The oxygen content which varies according to the composition is typically of the order of from 100 to 200 ppm, and the specific surface area, with respect to the grain size, is close to the minimum value of a quasi-spherical powder.

In regard to such spheroidal powders, the mechanical strength of the compressed components depends on the inter-particle contact surface produced in the compacting operation. In practice, it is found that, for a Vickers hardness under a load of 500 g, which is better than 100, the mechanical strength and resistance to crumbling of the compressed parts are at insufficient levels to permit normal handling of such compressed parts, which severely limits the potential uses of such powders for producing blanks by cold compacting.

SUMMARY OF THE INVENTION

The present invention seeks both to remove this severe limitation and to provide for the production of non-fragile shaped or molded parts with a Vickers hardness under a load of 500 g of better than 500, from powder formed by spheroidal metal particles.

The principle used is the incorporation in the metal powder, by a dry mixing process, of an organic binder in the form of powder of methyl cellulose type or more generally cellulose gums which are water-soluble polymers. The progressive incorporation in the mixture of an amount of water equal to the amount of methylcellulose, i.e., from 0.2 to 2% by weight, permits hydrolysis of the methylcellulose and avoids the phenomena of separation of the different constituents of the mixture, such as graphite powder, solid lubricant powder, etc. The mixture is then ready for use and imparts to the compressed parts a sufficient level of mechanical strength and resistance to crumbling, for normal handling, with compacting pressures of from 25 to 75 daN/mm$^2$. Such properties may be enhanced if necessary by an oven drying treatment at a temperature of 120° C. The organic binder is removed in the course of the sintering operation by a thermal treatment in a neutral or reducing atmosphere, which includes a plateau stage between 300° and 500° C., the sintering operation proper being performed in the same atmosphere under the conditions in respect of time and temperature which are required by the use and the composition involved. Determination measurments taken on a sintered product indicate an increase in the carbon content of less than 0.2 times the content of methylcellulose in the initial mixture and no variation in the oxygen content with respect to the gas-atomized powder.

Thus, the present invention provides a process for the production of shaped parts from powders comprising spheroidal metal particles mixed with from 0.2% to 2% of lubricant, characterized by the combination of the following successive operations in the below-indicated order:

(a) mixing of the powder comprising spheroidal metal particles with an amount of water-soluble cellulose gum which is from 0.2% to 2%, and with an amount of water which is also from 0.2% to 2%;

(b) a cold compacting operation;

(c) an optional drying operation; and (d) a two-phase sintering operation, in an atmosphere which is neutral or reducing with respect to the compacted powder, the first phase being effected at a temperature of from 300° to 500° C. and the second phase being effected at a temperature which is substantially higher and variable with the nature of the powder.

According to the invention, the cold compacting method may advantageously be selected from the group of methods comprising uni-directional compacting in a die, isostatic compacting, compacting by rolling and extrusion.

According to the invention, the powder which is used, comprising spheroidal metal particles, may advantageously be produced by the atomization of liquid metal by means of gas jets.

According to the invention, the cellulose gum used may advantageously be methylcellulose.

DETAILED DESCRIPTION

In order that the present invention may be more clearly understood four embodiments of the process according to the invention will now be described by way of non-limiting examples.

EXAMPLE 1

The production, from a substantially non-alloyed steel composition, of test pieces for determining the mechanical strength 'in the green condition', in the crude state of uni-directional cold compacting, without the final sintering step, in order to demonstrate merely the improvement, due to the invention, in the 'green' strength of the blanks which are cold compacted for the sintering operation.

(a) Known method: the following mixture was prepared from a powder which was atomized by means of gas:

500 grams of gas-atomized powder, steel composition Cd4 (C: at most equal to 0.05%, Cr: 1%, Mo: 0.25%, Mn: 0.8%), grain size <500 microns, Vickrs hardness under a load of 500 g, HV.0.5=206±20, 1.5 grams of graphite powder 7.5 grams of solid lubricating powder of stearate type.

Using this mixture, parallelepipedal test pieces measuring 33×12×6 mm were compacted under a pressure of 75 daN/mm$^2$. The resistance to rupture in respect of bending of such testpieces, which is determined in accordance with standard AFNOR A 95-206, is 0.100 daN/mm$^2$. This value is found to be scarcely sufficient for handling the compressed parts. Moreover, the resistance to disintegration or crumbling of the edges and the surfaces of the parts is low.

(b) Method according to the invention:

In comparison, a mixture was prepared from the following constituents:

500 grams of gas-atomized powder, steel composition 5 CD4, grain size <500 microns, Vickers hardness HV 0.5=205±20, 0.5 gram of graphite powder, 2.5 grams of solid lubricating powder of the stearate type, and 5 grams of methylcellulose powder.

5 cm$^3$ of water was incorporated to form a moist homogeneous mixture which is preserved in a closed container.

The testpieces which are compacted under a pressure of 75 daN/mm$^2$ have a resistance to rupture in respect of bending of 0.200 daN/mm$^2$. After an oven drying operation at a temperature of 120° C., the resistance to rupture in respect of bending is increased to 0.400 daN/mm$^2$. These values permit the compressed parts to be handled without the necessity for particular precautions. Moreover, the use of the hydrolyzed methylcellulose as a compacting binder provides a spectacular improvement in the resistance to crumbling of the edges and the surfaces of the compressed parts.

EXAMPLE 2

Production in accordance with the invention, from a substantially non-alloyed steel composition, of blanks for the sintering-forging of a sliding pinion of steel of composition 35 CD 4, by uni-directional cold compacting.

Taking a gas-atomized powder of composition 5 CD 4, with a grain size <500 microns, comprising the following additives by weight:

0.1% of graphite powder, 0.5% of solid lubricating powder of stearate type, and

1% of methylcellulose powder, a moist mixture was prepared in an industrial mixer with a capacity of 200 kg, by the incorporation of 1% water.

The compacting operation, in an annular shape, was effected under a pressure of 40 daN/mm$^2$, with an industrial mechanical press. The resulting density is 6.4 g/cm$^3$. Introduction of the powder into the press and ejection of the blank were performed automatically at a rate of 400 parts per hour.

The blanks may be shaped by the method of sintering-forging, a thermal cycle of reheating in a protective atmosphere including a plateau between 300° and 500° C. before the sintering operation proper at a temperature of 1150° C. The sintered blanks were densified by forging in a closed die using the method referred to as sintering-forging, which is well known to those skilled in the art. The resulting parts are of full density. The residual carbon content after forging is in accordance with the composition 35 CD 4, as well as the response to the treatment of surface hardening by carbonitriding.

EXAMPLE 3

Production in accordance with the invention of shaped parts of hard alloy by unidirectional cold compacting.

A mixture was prepared from the following constituents:

500 grams of gas-atomized powder, of Stellite 6 composition, of Vickers hardness HV 0.5=490±20, 2.5 grams of solid lubricating powder of stearate type, and 5 grams of methylcellulose powder.

5 cm$^3$ of water was incorporated to form a homogeneous moist mixture which is preserved in a closed container.

Samples in the form of plates measuring 33×12×4 mm and rings with an outside diameter of 20 mm, an inside diameter of 12 mm and a height of 12 mm, were compacted at pressures varying from 25 daN/mm$^2$ to 75 daN/mm$^2$. Although the relative density of such samples differs little from the relative density of the packed or compressed powder, they may be handled without the necessity for particular precautions.

By comparison, compressed components produced from mixtures without hydrolyzed methylcellulose are highly likely to crumble and cannot be handled, even after being compressed under a pressure of 150 daN/mm$^2$. It was possible to achieve virtually complete densification of such compressed components by a heat treatment under vacuum including a plateau between 300° and 500° C. and sintering at elevated temperature depending on the structure to be produced, which temperature may for example be between 1250° C. and 1350° C., in certain cases.

EXAMPLE 4

Production in accordance with the invention of shaped parts of hard alloy by isostatic cold compacting.

Taking the same mixture as that set forth in Example 3, spherical blanks were produced by isostatic cold compacting. The powder is placed in latex shaping molds and the molds are placed in a chamber in which a hydraulic pressure of from 2000 to 3500 bars is applied. This mode of operation results in balls measuring from 8 to 30 mm in diameter, which were sintered under the conditions set forth in Example 3.

EXAMPLE 5

Production in accordance with the invention of porous strips of stainless steel by compacting-rolling.

Taking a gas-atomized powder, of a steel composition 316 L, with a grain size of from 100 to 250 microns and comprising 1% by weight of methylcellulose, 1% of water was incorporated by passing it into a continuous mixer. The moist mixture was continuously fed into the roll gap of a two-high rolling mill provided with rolls which are 370 mm in diameter and a table width of 300 mm, with their respective axes of rotation disposed in the same horizontal plane. A coherent strip which was 300 mm in width, 100 mm in thickness, and with a density of 6.50 g/cm$^3$, was produced at a rate of 0.5 m/minute. After compacting by rolling, the strip passed at the same speed in a tunnel furnace in an atmosphere of cracked ammonia, comprising a region at a temperature of from 300° to 500° C. in which the organic binder is removed and a region at a temperature of 1150° C. in which the sintering operation proper is effected. The strip retains a porosity of 25% by volume and may be used for example as a filtering agent.

What is claimed is:

1. A process for the production of shaped parts from a powder comprising spheroidal metal particles, comprising the successive steps of (a) mixing said powder with from 0.2% to 2% of lubricant of stearate type;

(b) mixing said powder and said lubricant with from 0.2% to 2% of organic binder of cellulose gum type;

(c) mixing the powder thus obtained with an amount of water of from 0.2% to 2%;

(d) cold compacting the resulting mixture; and (e) subjecting said mixture to a two-phase sintering operation, in an atmosphere which is neutral or reducing with respect to said mixture, the first phase being effected at a temperature of from 300° to 500° C. and the second phase being effected at a temperature which is substantially higher.

2. A process according to claim 1, wherein the cold compacting method is selected from the group of methods comprising unidirectional compacting in a die, isostatic compacting, compacting by rolling and extrusion.

3. A process according to claim 1 or 2, wherein the powder used, comprising spheroidal metal particles, is produced by atomization of liquid metal by means of gas jets.

4. A process according to claim 1 or 2, wherein said cellulose gum is methylcellulose.

5. A process according to claim 1 or 2, wherein, between cold compacting and sintering, said mixture is oven dried.

* * * * *